US007527127B2

(12) United States Patent
Österman et al.

(10) Patent No.: US 7,527,127 B2
(45) Date of Patent: May 5, 2009

(54) ELEVATOR BRAKE MANAGEMENT SYSTEM

(75) Inventors: Jari Österman, Riihimäki (FI); Seppo Suur-Askola, Mommila (FI); Jarmo Myllynen, Hyvinkää (FI); Simo Mäkimattila, Espoo (FI); Jukka Korpela, Hyvinkää (FI); Joni Kiiski, Klaukkala (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/068,556

(22) Filed: Feb. 7, 2008

(65) Prior Publication Data

US 2008/0185231 A1 Aug. 7, 2008

Related U.S. Application Data

(63) Continuation of application No. PCT/FI2006/000278, filed on Aug. 16, 2006.

(30) Foreign Application Priority Data

Aug. 19, 2005 (FI) ..... 20050840

(51) Int. Cl.
*B66B 1/34* (2006.01)

(52) U.S. Cl. ..... 187/391; 187/288; 187/305; 187/361

(58) Field of Classification Search ..... 187/277, 187/281, 287, 288, 291, 293, 350, 301, 305, 187/351, 361, 373, 391–393
See application file for complete search history.

(56) References Cited

U.S. PATENT DOCUMENTS

| | | | | |
|---|---|---|---|---|
| 4,266,257 | A | 5/1981 | Rudich, Jr. | |
| 4,319,298 | A | 3/1982 | Davis et al. | |
| 4,928,796 | A | 5/1990 | Poon | |
| 5,323,878 | A * | 6/1994 | Nakamura et al. | 187/264 |
| 5,578,801 | A * | 11/1996 | Hofmann | 187/393 |
| 6,631,790 | B2 * | 10/2003 | Mattlar et al. | 187/375 |
| 7,268,514 | B2 * | 9/2007 | DeLange et al. | 318/757 |

FOREIGN PATENT DOCUMENTS

| | | | |
|---|---|---|---|
| JP | 01162690 | A * | 6/1989 |
| JP | 2005-170551 | A | 6/2005 |
| JP | 2005-194066 | A | 7/2005 |

* cited by examiner

*Primary Examiner*—Jonathan Salata
(74) *Attorney, Agent, or Firm*—Birch, Stewart, Kolasch & Birch, LLP

(57) ABSTRACT

In the invention a method is presented for ensuring operating safety in an elevator system, an elevator system, and a safety device of an elevator system. The elevator system includes at least an elevator car, elevator ropes, an elevator motor, a traction sheave and at least two holding brakes, which holding brakes are arranged to prevent movement of the elevator car when the elevator is stopped. According to the invention the first holding brake is engaged at the end of an elevator run, and the other holding brakes are engaged with a delay. When one holding brake is engaged, the state of motion of the elevator and any slipping of the brake is monitored. If the brake is detected as slipping, a procedure for preventing a hazardous situation is performed.

11 Claims, 2 Drawing Sheets

ELEVATOR BRAKE MANAGEMENT SYSTEM

Figure 1:
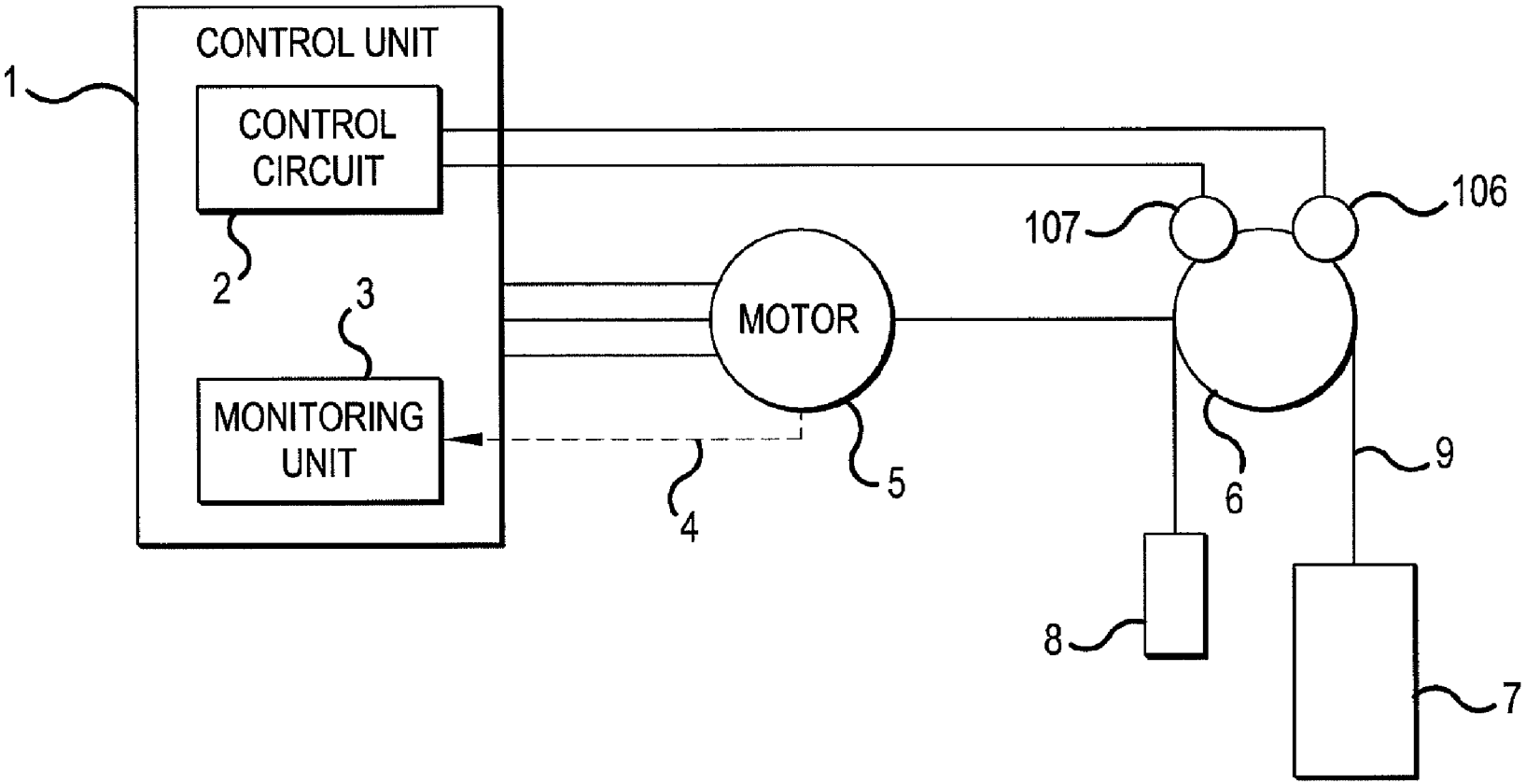

This application is a Continuation of copending PCT International Application No. PCT/FI2006/000278 filed on Aug. 16, 2006, which designated the United States, and on which priority is claimed under 35 U.S.C. § 120. This application also claims priority under 35 U.S.C. § 119(a) on Patent Application Ser. No(s). FI 20050840 filed in Finland on Aug. 19, 2005. The entire contents of each of the above documents is hereby incorporated by reference.

FIELD OF THE INVENTION

The present invention relates to a method as defined in the preamble of claim 1 for ensuring the operating safety of an elevator, an elevator system as defined in the preamble to claim 5 and a safety device as defined in the preamble of claim 9 for improving operating safety in an elevator system.

BACKGROUND OF THE INVENTION

In the mechanical control of the travel of the elevator cars of an elevator system, motors, brakes and a control system to control them are needed. The driving force from the motor travels to the elevator car via the traction sheave and the elevator ropes. The hoisting machine of the elevator comprises one or more holding brakes, which ensure that the car stays in its position when movement of the elevator could endanger the safety of elevator passengers. If for some reason a malfunction occurs in the holding brakes, it could result in a hazardous situation for users of the elevator.

A defect can occur in the mechanical system controlling an elevator car, from which e.g. oil may be released into the equipment. The penetration of oil or other dirt onto the brake drum may reduce the friction co-efficient between the braking surface and the brake pad so much that the brake begins to slip. In other words it is possible that the elevator car moves when the brake shoe is engaged against the braking surface. The friction between the braking surface and the brake pad may also be reduced as a result of other factors, such as incorrect adjustment of the brakes. In addition, the brake pad may wear so that the brake is not able to keep the elevator in its desired position.

In prior-art technology the problems relating to holding brakes have been solved mainly with a regular maintenance program, with which it is ensured that the brakes are in proper condition and that there is sufficient friction in the braking surfaces to keep the elevator in its position also with large loads of the elevator car.

The functionability of brake pads is analyzed in publication WO 03/059713. In the method the dielectric constant of the brake pad material is measured. When the value of the dielectric constant of a new brake pad that is in good condition is known, the measured value can be compared to it. If the measured value is not within the desired tolerance range around the reference value, it is concluded that the operating capability of the brake pads has deteriorated and in that case a service operative can be called to the site immediately.

The purpose of publication EP 1127025 is to present a holding brake, in which the degree of wear of the brake is measured constantly and thus the need for servicing can be forecast. In the method the position of the brake shoe is measured with a sensor in the braking state and in the releasing state. Based on these the quality of the operation of the brakes and the condition of the brake shoe and the braking surfaces can be determined.

Publication EP 502282 presents an appliance for monitoring the condition of brakes, to which a traction sheave rotated by the motor is connected. Wear of the friction surface of the brake is monitored with wear sensors. The position of the brake pads in relation to the traction sheave is observed with position sensors. By using simulated fault signals the monitoring signals given by the sensors are inspected at certain intervals and also the operability of the monitoring equipment itself. When the system identifies abnormal wear of the friction surface, an abnormal gripping attitude of the brake pads or if the appliance does not react to the simulated fault signals, the motor is switched off.

A drawback of prior-art methods for inspecting the condition of brakes is that they expose the appliance to a direct safety risk. Furthermore prior-art measuring and maintenance arrangements incur large extra costs.

PURPOSE OF THE INVENTION

The purpose of the present invention is to present an effective safety device for an elevator system, wherein a hazardous situation for elevator passengers does not arise when the traction sheave of the elevator machine slips. The purpose of the invention is also to present a method for ensuring the operating safety of an elevator system, as well as a safer elevator system than a prior-art one.

SUMMARY OF THE INVENTION

The method according to the invention for ensuring the operating safety of an elevator is characterized by what is disclosed in the characterization part of claim 1. The elevator system according to the invention is characterized by what is disclosed in the characterization part of claim 5. The safety device according to the invention is characterized by what is disclosed in the characterization part of claim 9. Other embodiments of the invention are characterized by what is disclosed in the other claims. Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts.

The present invention pertains to improving safety in an elevator system, which elevator system comprises at least one elevator car, which elevator car is supported at least partially by means of elevator ropes, elevator ropes, an elevator motor, a traction sheave for moving the elevator car via the elevator ropes, and in which elevator system two or more holding brakes are arranged to hold the elevator car in its position when the elevator is stopped. In a prior-art elevator system using two holding brakes, typically both holding brakes simultaneously engage when the elevator run ends. According to the invention only one holding brake engages when the elevator run ends, and the other holding brakes engage after a delay. When the elevator is stopped and empty and when the first holding brake has engaged, motor torque is increased to a certain limit. The state of motion of the elevator is checked, i.e. the speed and/or direction of movement of the elevator car. If movement of the elevator car is detected when the first holding brake has engaged, the operation of the brakes is impaired and there is slip in the brake. The torque at which slipping starts is registered, and to prevent a hazardous situation one or more procedures for preventing a hazardous situation are performed.

In a preferred embodiment of the invention one procedure for preventing a hazardous situation is prevention of the operation of the motor, until the operating condition of the brakes is checked. In one embodiment of the invention a second holding brake is set to engage immediately, if a change in the state of motion of the elevator is detected after one holding brake is engaged.

The elevator system according to the invention comprises means for controlling the holding brakes of the elevator, with which means one of the holding brakes can be controlled to close immediately the elevator run ends, and the other holding brake can be controlled to close with the desired delay, means for monitoring slipping of the brake of the elevator, means for increasing motor torque to a certain limit, means for registering the torque at which slipping starts, and means for performing a procedure intended to prevent a hazardous situation, in which the first holding brake is engaged when the brake is detected as slipping. In one embodiment of the invention the means for performing a procedure intended to prevent a hazardous situation comprise means for preventing the starting of the motor. The elevator system can further comprise fault message transmission means for transmitting a fault notification.

The safety device according to the invention can be fitted as a part of the elevator system for improving operating safety, which elevator system comprises an elevator car, which elevator car is supported at least partially by means of elevator ropes, elevator ropes, a traction sheave for moving the elevator car via the elevator ropes and an elevator motor, a sensor for measuring the speed of rotation of the elevator motor, a sensor for monitoring the temperature of the motor and means for disconnecting the electrical power supply of the motor in a situation where the motor overheats, and at least two electromagnetic holding brakes, which holding brakes are arranged to prevent movement of the elevator car when the elevator is stopped, and means for closing the holding brakes at the end of an elevator run. The safety device comprises a slip status monitoring unit, which comprises means for monitoring the state of motion of the elevator and for detecting a slipping situation, means for delaying engagement of the second holding brake, means for increasing motor torque to a certain limit, means for registering the torque at which slipping starts, and means for preventing starting of the motor when the brake is slipping after the first holding brake is engaged.

In one embodiment of the invention the safety device is fitted as a part of the elevator system, and the safety device is arranged to monitor the state of motion of the elevator based on information transmitted from the sensor measuring the speed of rotation of the motor, to produce a delay in the engagement of the second holding brake by means of an energy store connected to the electrical power supply of the second holding brake, and to prevent starting of the motor in a situation where the brake is slipping utilizing the means of the elevator system for disconnecting the electrical power supply of the motor in a situation where the motor overheats. The safety device can be arranged to detect a slipping situation based on speed reference data transmitted from the control unit of the elevator and information received from the sensor measuring the speed of rotation of the motor. The means for delaying engagement of the second holding brake can comprise a capacitor. In one embodiment of the invention the safety device is located in the terminal box between the control unit of the elevator and the hoisting machine of the elevator.

One advantage of the solution according to the invention is that adequacy of the friction coefficient between the braking surface and the brake pad is checked in conjunction with each stop. If slipping of the brake is detected when using one holding brake, the slipping can be stopped by means of the second holding brake such that no hazardous situation can arise. A further advantage of the invention is that the safety device can be used to improve the safety of elevator systems that are already installed and in use in buildings, because the device can easily be fitted to existing elevator systems.

In a situation in which the first holding brake slips, the system can create a signal, which is directed to the service center of the elevator system. It is then known at the service site that the brake requires servicing, and thus e.g. the brakes can be re-adjusted or the brake pads can be replaced with new ones.

One advantage of the present invention is that the safety risk attached to the operation of the holding brake is reduced in comparison with prior-art technology. The safety device according to the invention is simple in structure, and can easily be fitted to existing elevator systems. By means of some embodiments of the invention the efficiency of the servicing of an elevator system can also be improved, as information about impairment of the operation of the brake can be sent to the service center. In this case unnecessary inspection visits can be avoided by means of remote monitoring.

LIST OF FIGURES

Figure 2:
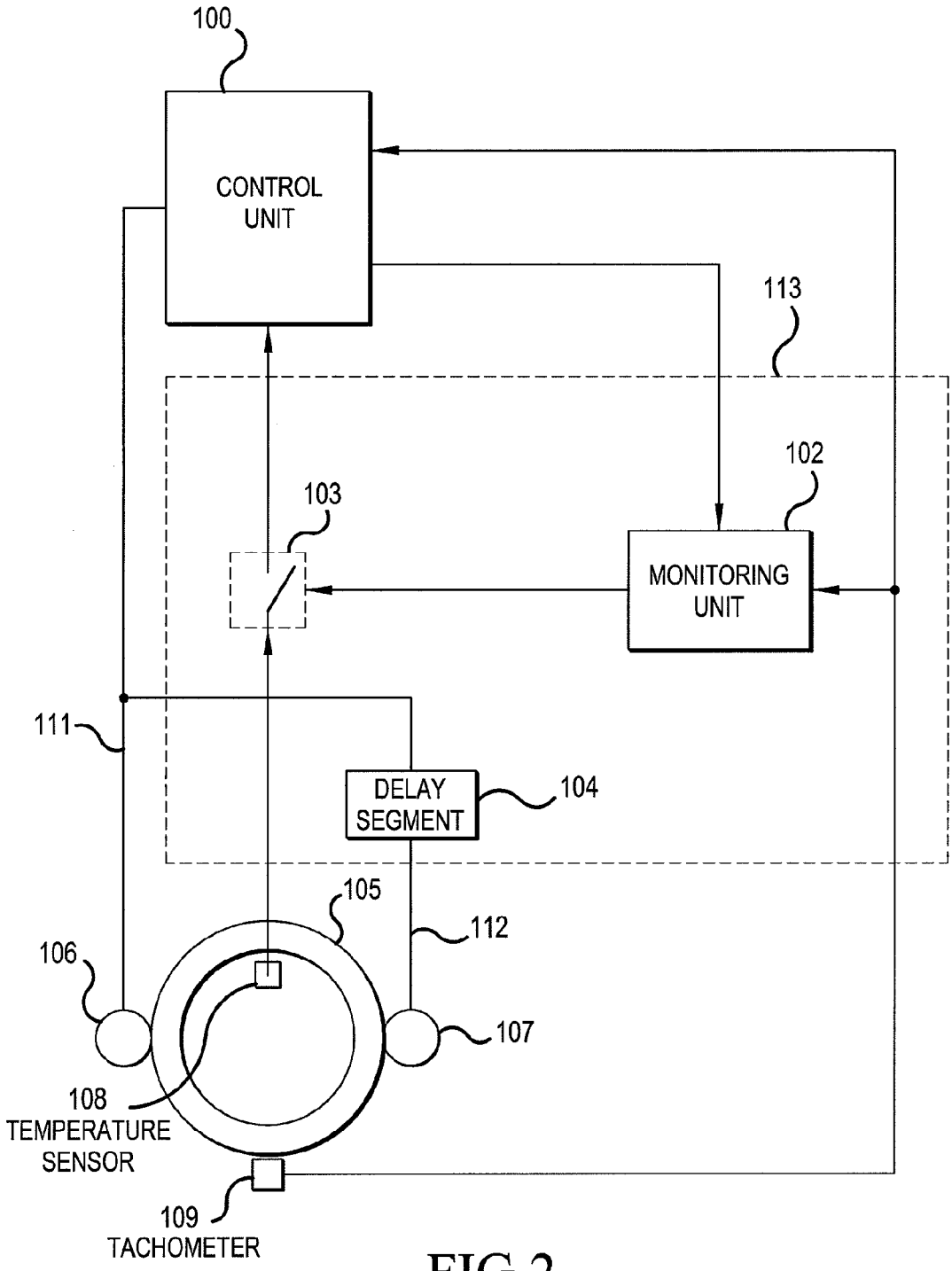

In the following, the invention will be described in detail by the aid of a few examples of its embodiments with reference to the attached drawings, wherein FIG. 1 presents an elevator system according to the invention FIG. 2 presents a diagram of a safety device according to the present invention fitted to an elevator system.

DETAILED DESCRIPTION OF THE INVENTION

The invention pertains to the improvement of safety in an elevator system, which comprises at least one elevator car, elevator ropes, an elevator motor, a traction sheave and at least two holding brakes per elevator car. With the invention the operating safety of elevators can be improved in a situation in which the friction coefficient between the brake shoe and the brake drum of the holding brake is reduced owing to wear of the brake or owing to some other reason. A contaminating substance such as oil or dirt can find its way onto the braking surface, or the brakes can be incorrectly adjusted. The invention also presents a new elevator system that is better in terms of operating safety than prior-art.

FIG. 1 presents an elevator system according to the invention. The elevator car 7 can be moved in the elevator shaft (not shown in the figure) in the desired manner via the elevator motor 5, the traction sheave 6 and the elevator ropes 9. The elevator system according to FIG. 1 comprises in addition a counterweight 8, but the invention can also be applied in elevator systems in which there is no counterweight 8. The traction sheave 6 can be either integrated as a part of the elevator motor 5, or it can be connected to it in a suitable manner. The elevator motor 5 is preferably a permanently magnetized synchronous motor, but it can also be some other electric motor, such as an induction motor. The motions of the motor 5 can be controlled by means of the supply unit and control unit 1 of the elevator motor. The elevator system according to the invention contains at least two holding brakes 106 and 107, which are preferably electromagnetic brakes. When it is desired that the elevator car 7 is able to move, the holding brakes are kept open by supplying electric current to the brake magnets. When it is desired that the elevator car stays in its position, the brakes are engaged by disconnecting the electrical power supply to them. The holding brakes can be fitted in connection with the hoisting machine of the elevator e.g. such that when the brake is engaged the brake shoe presses against the braking surface that is connected to the traction sheave 6. The brake drum, against which the brake shoe is arranged to press, can also be positioned separately from the traction sheave. The elevator system according to FIG. 1 in addition comprises the control circuit 2 of the brakes as well as the slip status monitoring unit 3, which in this example are connected to the supply unit and monitoring unit 1 of the elevator motor. The units can however be disposed separately from each other.

The numeral 4 refers to information about the state of motion of the elevator, which can be transmitted to the slip status control and monitoring unit 3. The information can be received e.g. from the speed of rotation sensor or resolver connected to the elevator motor 5 or from the positioning device connected to the elevator car 7 or disposed in the elevator shaft.

All prior-art techniques can be applied to the control of the elevator car in the elevator system according to the invention. The following addresses the operation of the elevator system after an elevator run ends. When the elevator car 7 has arrived at its destination floor, it stops. Before torque is removed from the motor 5, the first holding brake 106 is engaged to hold the elevator car in its position. According to the invention the second holding brake 107 is engaged after a delay, in which case the operability of the first holding brake can be checked before the engagement of the second holding brake. If there is no slipping, the elevator system can continue its operation normally, and when the elevator is starting its next run the necessary torque is set for the motor 5 and the holding brakes are opened to enable movement of the elevator car. The holding brakes can be opened either simultaneously, or one of them can be opened after a delay.

When the first holding brake 106 is engaged and torque has been removed from the motor after the elevator has stopped, the elevator car 7 should stay in its position. If the elevator is detected as moving at this stage, it can be interpreted as the first holding brake not being able to keep the elevator car in its position i.e. the brake is slipping. If slipping is detected, one or more procedures for preventing a hazardous situation are performed in the elevator system. The second holding brake 107 can be engaged immediately that slipping is detected, to prevent movement of the elevator car. It is also possible to prevent starting of the elevator motor 5 and thus operation of the elevator, until the operating condition of the brakes is checked and the elevator is verified as safe. An inspection and any repair or cleaning of the braking surface can be performed by e.g. a serviceman, who after verifying the safety of the elevator may return the elevator to operable status again. It is also possible that the system comprises means for sending a fault notification to the service center or similar remote monitoring center, in which case the information about a possible slipping condition can immediately be transmitted in real-time, and a serviceman can arrive at the site to rectify the situation.

In one embodiment of the invention the procedure for preventing a hazardous situation is engagement of the second holding brake immediately that slipping of the brake is detected.

In one embodiment of the invention an inspection of the condition of the brakes according to the invention is performed after the elevator has stopped and before the opening of the doors of the elevator car. The doors are only opened when both holding brakes are engaged. This ensures that the elevator car stays in its position and prevents the occurrence of a hazardous situation, in a situation in which the doors of the elevator can be opening, closing or fully open.

In one preferred embodiment of the invention the elevator motor is a permanently magnetized synchronous motor, which is arranged to dynamically brake movements of the elevator car when it is desired that the elevator car stays in its position.

Typically the first and second holding brake 106 and 107 have similar properties to each other and are installed in a similar fashion to each other. In one elevator system according to the invention the holding brakes differ to each other in that the brake shoes of the brakes 106 and 107 are arranged to press against the braking surface with forces of different magnitudes. If the first holding brake 106 is arranged to be weaker than the second holding brake 107, a weakening of the friction coefficient between the brake shoe and the braking surface is detectable at an early stage, as slipping occurs with small changes in the friction coefficient. When a slipping situation is detectable from even small changes in the state of motion of the elevator, and the second holding brake, being stronger, is able to stop the slipping that has started, the said system does not cause situations that are hazardous to the elevator passengers. In the embodiment presented above the procedure for preventing a hazardous situation can be e.g. that information about the impairment of the operation of the brake is sent to the service center. In addition, the control of the brakes of the elevator can be changed so that both holding brakes are immediately engaged after each run until the operation of the brakes of the elevator has been verified. In this case it can be possible to continue to use the elevator system despite the slipping of the weaker holding brake, especially if the forces of the holding brakes differ from each other substantially, and if the slipping has been small and has occurred with a large load on the elevator. In one embodiment of the invention the control unit and monitoring unit 3 for the slipping status of the brake of the elevator monitors the magnitude of the slipping, the load status of the elevator car when slipping occurs, and determines the preventive procedures to be performed to prevent a hazardous situation using the aforementioned parameters.

In one embodiment of the invention the elevator system comprises a third holding brake, the brake shoe of which is arranged to press against the braking surface with a smaller force than the brake shoes of the first and second holding brake. By engaging the third holding brake before the other holding brakes, and by monitoring the state of motion of the elevator when movement of the elevator car is prevented only by the third holding brake, weakening of the friction properties of the braking surface can be detected in good time. If the slipping is small when using only a third, but weaker, holding brake, and the slipping occurs when the load is great, the two stronger holding brakes are still able to keep the elevator car in its position during normal operation of the elevator. To ensure safety, the operation of the motor can however be prevented in a slipping situation, or another applicable procedure can be performed.

In one embodiment of the invention the condition of the brakes of the elevator system are tested with the method according to the invention, when the elevator car is empty. This can be verified by e.g. supplying the load information of the elevator car to the control unit and monitoring unit 3 for slipping status. In a preferred embodiment of the invention the elevator system comprises three holding brakes, the brake shoe of one being arranged to press against the braking surface with a smaller force than the brake shoes of the other brakes. When the elevator car is empty, e.g. after arriving at a floor to answer a call placed by a user, the condition of the brakes of the elevator is checked by means of the weakest holding brake, and the doors of the elevator car and operation of the elevator are permitted only if no slipping is detected in the brakes of the elevator when the car is held in its position by only the weakest holding brake.

In one embodiment of the invention the holding brake engaged first at the end of the runs of the elevator is alternated such that when at the end of one run the first holding brake 106 is engaged first and the second holding brake 107 with a delay, at the end of the following run the second holding brake 107 is engaged first and the first holding brake 106 with a delay. In this way it is possible to continuously monitor the operating condition of both holding brakes and to evenly distribute wear of the brake pads.

The elevator system according to the invention can also comprise means for collecting and storing information, which can be situated e.g. in connection with the slip status monitoring unit. The information collected about the operation of the brakes of the elevator system can further be utilized for more detailed analysis of the operation of the brakes and for condition monitoring. For example, it is possible to store information about the slipping distance of the brake at different times. By means of the stored measurement results it is possible to analyze trends in the development over time of the slipping distance, such as an increase or a decrease of the slipping distance during normal operation of the elevator. Travel data can be obtained e.g. by integrating the measurement result of the speed sensor, or on the basis of the position measuring of the resolver or the shaft. It is also possible to store the load information of the elevator car, in which case it is possible to analyze slipping of the brake as a function of the load data when monitoring the condition of the brake. The elevator system can further comprise a remote monitoring appliance, to which the aforementioned information can be connected.

The elevator system according to the invention can also be arranged to perform testing of the brake by means of the control system of the elevator at other times than in conjunction with normal elevator runs. A self-diagnostic function can be implemented e.g. such that torque is generated in the motor when the elevator car is empty and one of the brakes is engaged. The torque is increased to a certain limit, and if slipping is detected in the brake, the torque at which slipping starts is registered. In elevators without compensating ropes the test is preferably performed when the empty elevator car is at the topmost floor, in which case the mass of the ropes is most unfavorably distributed from the standpoint of brake gripping. In this case it is possible to e.g. after replacement or adjustment of the brakes compare the torque needed to start the slipping with the old brakes to the torque needed to start the slipping with the new or adjusted brakes, and to ensure that the repair procedure was of benefit.

FIG. 2 presents the safety device 113 of the invention fitted to an elevator system to improve its operating safety. The elevator system could have been installed and in use in the building before the fitting of the safety device. The safety device can be connected e.g. in the junction box between the control unit and the hoisting machine 105 of the elevator, or it can be disposed in another suitable location. The safety device can also be integrated into the control system of the elevator. FIG. 2 presents an embodiment of the safety device, in which the safety device is fitted to the elevator system utilizing the features already existing in the elevator system, such as measurement of the speed of rotation of the elevator motor and temperature monitoring and overheating protection of the motor. Consequently the safety device can be fitted into an existing system without the need to add new sensors or to make modifications to the functioning of the control unit of the elevator.

The elevator system comprises an elevator hoisting machine 105, which comprises a traction sheave and an elevator motor, a sensor 109 for measuring the speed of rotation of the elevator motor, such as a tachometer, a sensor 108 for monitoring the temperature of the motor, such as a thermistor, and at least two electromagnetic holding brakes 106, 107, which are arranged to prevent movement of the elevator car when the elevator is stopped. The information received from the thermistor 108 and the tachometer 109 is arranged to be transmitted to the control unit of the elevator. The control unit 100 of the elevator comprises means for controlling and supplying power to the elevator motor, a control circuit for the brakes of the elevator, i.e. means for closing the holding brakes at the end of an elevator run, and means for disconnecting the power supply to the motor in a situation where the motor overheats. The elevator car and the elevator ropes that are also included in the elevator system are not presented in FIG. 2.

The safety device 113 comprises a slip status monitoring unit 102, means 104 for delaying engagement of the second holding brake, and means for performing a measure intended to prevent a hazardous situation. Preferably the means for performing a measure intended to prevent a hazardous situation comprise means for preventing starting of the motor.

The slip status monitoring unit 102 comprises means for monitoring the state of motion of the elevator and for detecting a slipping situation. In the embodiment presented in FIG. 2 the state of motion of the elevator is monitored based on the information transmitted from the sensor 109 that measures the speed of rotation of the motor. The voltage signal produced by the tachometer indicates the speed of rotation and the direction of the elevator motor and thus also the state of motion of the elevator. A slipping situation can be diagnosed directly on the basis of the tachometer data e.g. such that a certain value range of the tachometer signal is specified for the slip status monitoring unit, which if it continues for a certain time can be diagnosed as slipping of the brake of the elevator. This is possible because when the brake slips the speed of rotation of the elevator motor is smaller than in a normal run of the elevator. Since there is no run phase in the normal time cycle of the elevator in which the motor rotates at very low speed and acceleration, a slipping situation can be deduced if necessary by monitoring the values of just this one signal. It is further possible to bring information about the desired state of motion of the elevator from the control unit 100 of the elevator to the slip status monitoring unit 102, e.g. the speed reference of the elevator. In this case diagnosis of slipping of the brake can be made utilizing both the speed reference signal and the tachometer signal. If the speed reference is zero, but the tachometer signal indicates the motor is rotating, it can be deduced that slipping of the brake is occurring. A slipping situation can also be detected with another method suited to the purpose.

Prevention of the starting of the motor is implemented in the solution according to FIG. 2 with the switch 103, by means of which the thermistor circuit arranged to monitor the temperature of the motor can be disconnected. If slipping of the brake is detected when the first holding brake is engaged, the slip status monitoring unit 102 produces a signal, which opens the switch 103, in which case the control unit 100 of the elevator disconnects the electrical power supply of the motor.

The electromagnetic holding brakes of the elevator receive their operating electricity from the circuits 111 and 112. The circuits are typically connected in parallel such that they are supplied with one control circuit arranged in connection with the control unit of the elevator. Delay of the second brake can be implemented in the safety device by connecting an energy store, such as a capacitor, to the electrical power supply of the second holding brake, in which case the electrical power supply of the second holding brake is not interrupted immediately when the control circuit disconnects the operating electricity of the brakes. The delay in engaging the second holding brake, which is produced by the unit 104, can be e.g. in the range of some hundreds of milliseconds. The magnitude of the delay can be adjusted by changing the magnitude of the capacitance of the capacitor.

In the present invention it is possible to change the delay segment 104 for the supply circuit 112 of the first holding brake 106 such that the second holding brake 107 is engaged first, in which case the first holding brake 106 is engaged with a delay period 104 after engagement of the second holding brake 107. With this arrangement it is possible to achieve an advantage, if one of the holding brakes works clearly more effectively than the other owing to e.g. differences in the physical condition of brake pads.

The invention is described above with the aid of a few examples of its embodiments. It is obvious to the person skilled in the art that the invention is not limited only to the examples described above, but that they may be varied within the scope of the inventive concept defined in the claims presented below.

The invention claimed is:

1. Method for ensuring operating safety in an elevator system, which elevator system comprises at least one elevator car, which elevator car is supported at least partially by means of elevator ropes, elevator ropes, an elevator motor, a traction sheave for moving the elevator car via the elevator ropes, and at least two holding brakes, which holding brakes are arranged to prevent the elevator car from moving when the elevator is stopped, comprising the method comprises the phases:

a. only one holding brake is engaged at the end of an elevator run and the other holding brakes are engaged with a delay b. the state of motion of the elevator and any slipping of the brake with one holding brake engaged are monitored c. if the brake is detected as slipping, a measure to prevent a hazardous situation is performed, wherein the motor is prevented from starting if the brake is detected as slipping in phase b).

2. Method according to claim 1, wherein the method comprises the phase:

at least one of the holding brakes is engaged immediately if a change is detected in the state of motion of the elevator after one holding brake has closed.

3. Method according to claim 1, wherein the method further comprises the phase:

a fault notification is sent to the service center if the brake is detected as slipping in phase b).

4. Elevator system, which comprises at least one elevator car, which elevator car is supported at least partially by means of elevator ropes, elevator ropes, a traction sheave for moving the elevator car via the elevator ropes, an elevator motor, and at least two holding brakes per elevator car, which holding brakes are arranged to prevent the elevator car from moving when the elevator is stopped, wherein the elevator system further comprises means for controlling the holding brakes of the elevator, with which means i. one of the holding brakes can be controlled to close immediately at the end of an elevator run, and ii. the other holding brakes can be controlled closed with the desired delay means for monitoring slipping of the brake of the elevator means for performing a procedure intended to prevent a hazardous situation, in which the first holding brake is engaged when the brake is detected as slipping, wherein the force with which the brake shoe of one holding brake is arranged to press against the braking surface is smaller than the force with which the brake shoe of at least one of the other holding brakes is arranged to press against the braking surface.

5. Elevator system according to claim 4, wherein the means for performing a procedure intended to prevent a hazardous situation comprise means for preventing starting of the motor.

6. Elevator system according to claim 4, wherein the system further comprises means for transmitting fault notifications.

7. Safety device for improving operating safety in an elevator system, which elevator system comprises an elevator car, which elevator car is supported at least partially by means of elevator ropes, elevator ropes, a traction sheave for moving the elevator car via the elevator ropes and an elevator motor, a sensor for measuring the speed of rotation of the elevator motor, a sensor for monitoring the temperature of the motor means for disconnecting the electrical power supply of the motor in a situation where the motor overheats, and at least two electromagnetic holding brakes, which holding brakes are arranged to prevent movement of the elevator car when the elevator is stopped; and means for closing the holding brakes at the end of an elevator run, and which safety device can be fitted as a part of the elevator system, wherein the safety device comprises:

means for delaying engagement of the second holding brake a slip status monitoring unit, which comprises means for monitoring the state of motion of the elevator and for detecting a slipping situation means for preventing starting of the motor if the brake is slipping when the first holding brake is engaged.

8. Safety device according to claim 7, wherein the safety device is fitted as a part of the elevator system, and the safety device is arranged to produce a delay in the engagement of the second holding brake by means of an energy store connected to the electrical power supply of the second holding brake to monitor the state of motion of the elevator based on information transmitted from the sensor measuring the speed of rotation of the motor, and to prevent starting of the motor in a slipping situation of the brake utilizing the means of the elevator system for disconnecting the electrical power supply of the motor in a situation where the motor overheats.

9. Safety device according to claim 8, wherein the safety device is arranged to detect a slipping situation based on speed reference data transmitted from the control unit of the elevator and information received from the sensor measuring the speed of rotation of the motor.

10. Safety device according to claim 7, wherein the means for delaying engagement of the second holding brake comprise a capacitor.

11. Safety device according to claim 7, wherein the safety device is disposed in the terminal box between the control unit of the elevator and the hoisting machine of the elevator.

* * * * *